US006679160B1

(12) United States Patent
Wise et al.

(10) Patent No.: US 6,679,160 B1
(45) Date of Patent: Jan. 20, 2004

(54) DUAL AIR ACTUATOR FOR OPERATING AN AIR CHUCK

(75) Inventors: Thomas E. Wise, Columbia City, IN (US); Ray D. Warren, Huntertown, IN (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/112,054

(22) Filed: Apr. 1, 2002

(51) Int. Cl.[7] ..... F01L 15/00
(52) U.S. Cl. ..... 91/189 A; 91/422
(58) Field of Search ..... 91/189 A, 422, 91/511; 92/110

(56) References Cited

U.S. PATENT DOCUMENTS 3,641,875 A * 2/1972 Kodalle ..... 91/422
5,106,244 A * 4/1992 Sato ..... 409/225
6,257,122 B1 * 7/2001 Michler et al. ..... 92/110

* cited by examiner

*Primary Examiner*—Edward K. Look
*Assistant Examiner*—Michael Leslie
(74) *Attorney, Agent, or Firm*—Rader, Fishman & Grauer PLLC

(57) ABSTRACT

An actuator is provided that includes an operating shaft positioned within a chamber for movement between a first position and a second position, and a longitudinal bore for delivering air to an air chuck. A piston is disposed around the operating shaft and is reciprocally mounted in the chamber. When pressurized air is applied to the first side of the chamber, the piston is shifted against a second stop surface at the second side of the chamber allowing pressurized air to flow through the bores in the operating shaft to the air chuck. When pressurized air is applied to the second side of the chamber, the piston moves away from the second stop surface to move the piston to the first position from the second position, while air within the operating shaft is depressurized allowing the air chuck to decouple the operating shaft and chuck from the object being rotated.

6 Claims, 7 Drawing Sheets

DUAL AIR ACTUATOR FOR OPERATING AN AIR CHUCK

FIELD OF THE INVENTION

The present invention is related to dual air actuator for operating an air chuck. More particularly, the present invention is directed to a dual air actuator for operating an air chuck on a balancing machine to couple a drive shaft thereto.

BACKGROUND OF THE INVENTION

The use of air pressure to actuate air chucks for coupling devices to machines, such as shaft balancing machines, is widely practiced. Exemplary of an air chuck is U.S. Pat. No. 5,106,244, incorporated herein in its entirety. In the past devices such as drive shaft balancing machines employed rotating air lines to carry a constant source of operating air to air actuate jaw members. These rotating air lines proved difficult to balance and transmitted vibration to the balancing machine Since the rotating air lines were subject to friction wear, arrangements were developed utilizing stationary air lines with springs to return actuators for air chucks to a decoupled mode. It has been found that these spring couplings stick or lock resulting in weak and/or broken springs. Therefore, there is a need for an air coupling used with balancing machines which does not have the drawback of broken springs requiring substantial machine down time, inconvenience and aggravation to repair, only to have the same failure reoccur.

SUMMARY OF THE INVENTION

The present invention is directed to an air actuator for actuating and providing air to an air chuck which couples an object for rotation wherein the actuator comprise a housing defining cylindrical chamber having a first stop surface and a second stop surface. A first pressure line is connected to a first side of the chamber and a second pressure line is connected to a second side of the chamber for applying pressure to the first and second sides of the chamber, respectively. An operating shaft is positioned within the chamber for movement between a first position adjacent to the first stop surface and a second position adjacent to the second stop surface, the shaft having a longitudinal bore for delivering air to the pneumatic chuck, which longitudinal bore is in communication with a radially extending bore. A piston is disposed around the operating shaft and is reciprocally mounted in the chamber for movement between the first stop surface and the second stop surface, wherein when pressurized air is applied to the first side of the chamber, the piston is shifted from the first stop surface against the second stop surface at the second side of the chamber. This allows pressurized air to flow through the bores in the operating shaft to the air chuck. When pressurized air is applied to the second side of the chamber, the piston moves away from the second stop surface from the second position back to the first position. This disengages the operating shaft from the clutch and decouples the chuck and the object being rotated.

In a specific aspect of the invention, the operating shaft is not biased by a spring.

In still another aspect of the invention, the radially extending bore in the operating shaft is closed when the operating shaft is in the first position and open when the operating shaft is in the second position.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
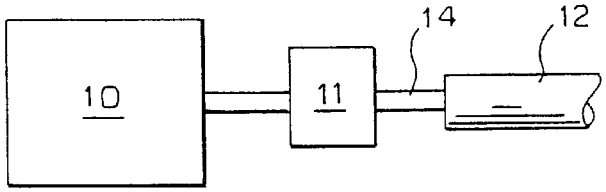
FIG. 1 is a schematic view of a balancing machine having an air chuck for supporting a drive shaft to be rotated by the balancing machine.

Referring now to FIG. 1, there is diagrammatically shown a balancing machine 10 having an air operated chuck 11 which couples a drive shaft 12 to a spindle 14 so that the balancing machine can rotate the drive shaft and test the drive shaft for proper balance. The air operated chuck 11 is actuated by an actuator 20, configured in accordance with the present invention.

Figure 2:
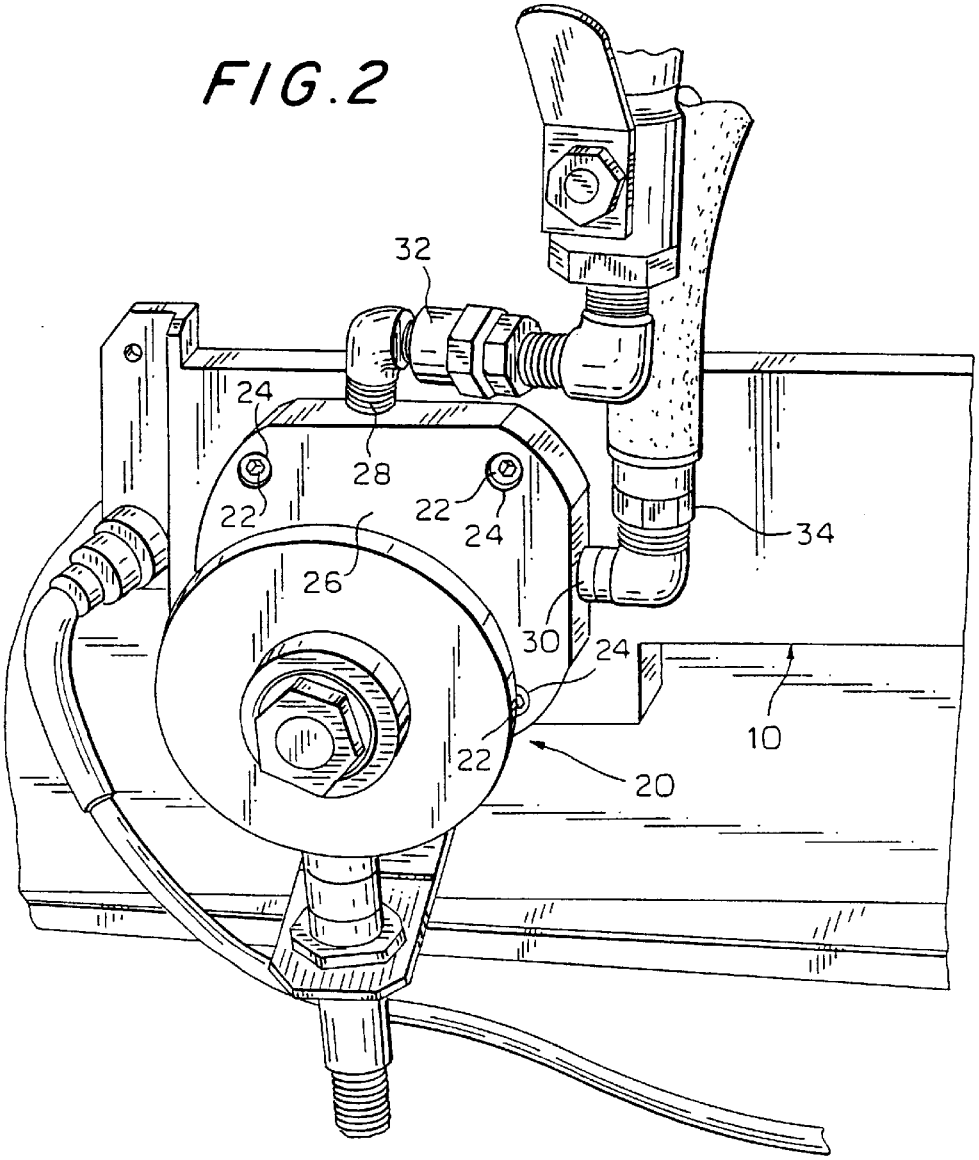
FIG. 2 is a perspective view of actuator for the air chuck of FIG. 1, the actuator being connected to air pressure line and a vacuum line.
Figure 3:
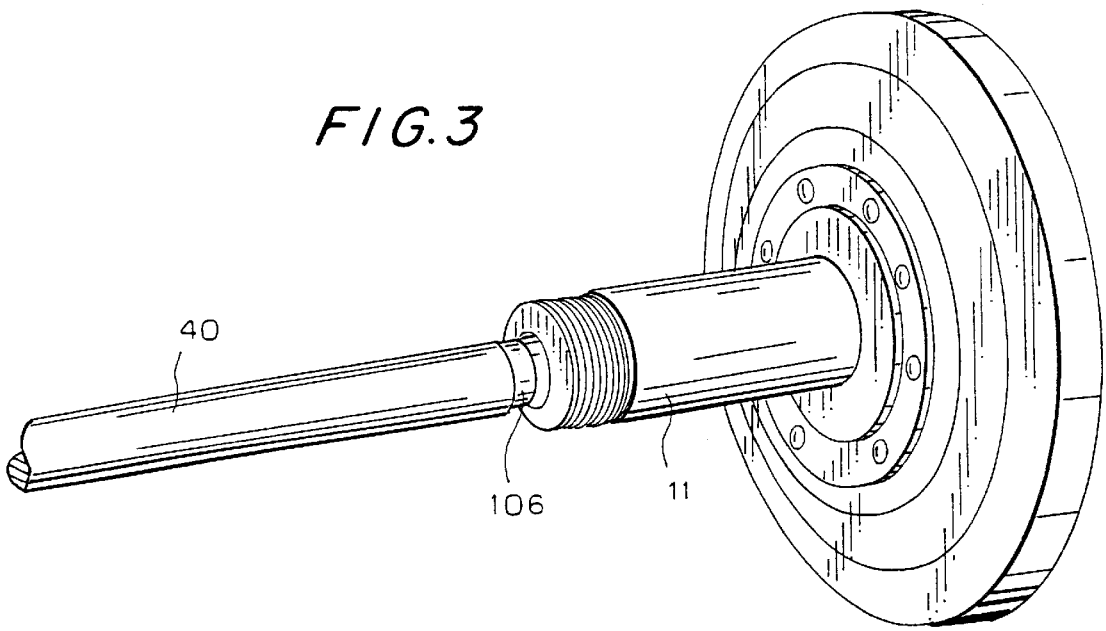
FIG. 3 is a perspective view of the actuator prior to coupling with an air chuck.
Figure 4:
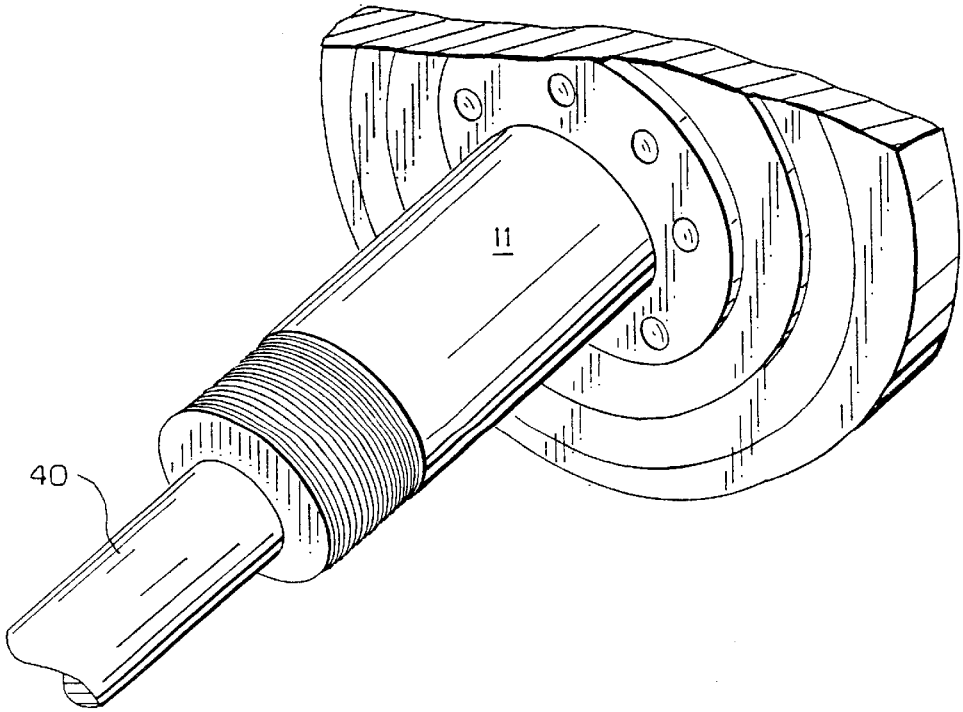
FIG. 4 is perspective view of the actuator prior to coupling with an air chuck.

Referring now to FIG. 2, there is shown a perspective view of the air actuator 20 which is fixed to the balancing machine 10 by four bolts 22 which pass through bolt holes 24 in a housing 26. Housing 26 has first pressure port 28 and a second pressure port 30 connected to the housing by pressure lines 32 and 34, respectively. Upon applying pressure to line 32 the actuator 20 engages the air chuck 11 with the drive shaft and upon applying pressure to the line 34 the actuator disengages the air chuck 11 from the drive shaft 12 (see FIG. 1). The actuator 20 includes an operating shaft 40 which is shown in FIG. 3 decoupled from the air chuck 11 on the balancing machine 10, and in FIG. 4 is shown coupled to the air chuck.

Figure 5A:
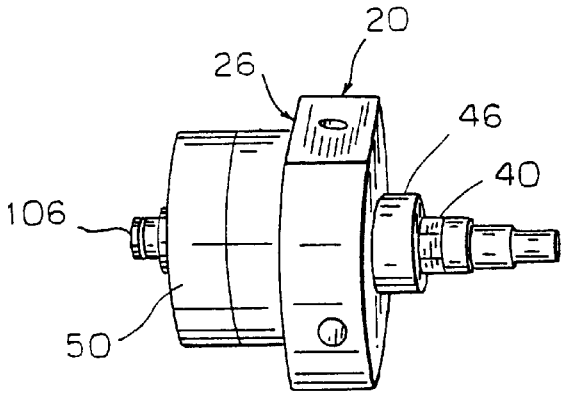
FIG. 5A is a perspective view of the actuator as a unit, separated from the balancing machine.
Figure 5B:
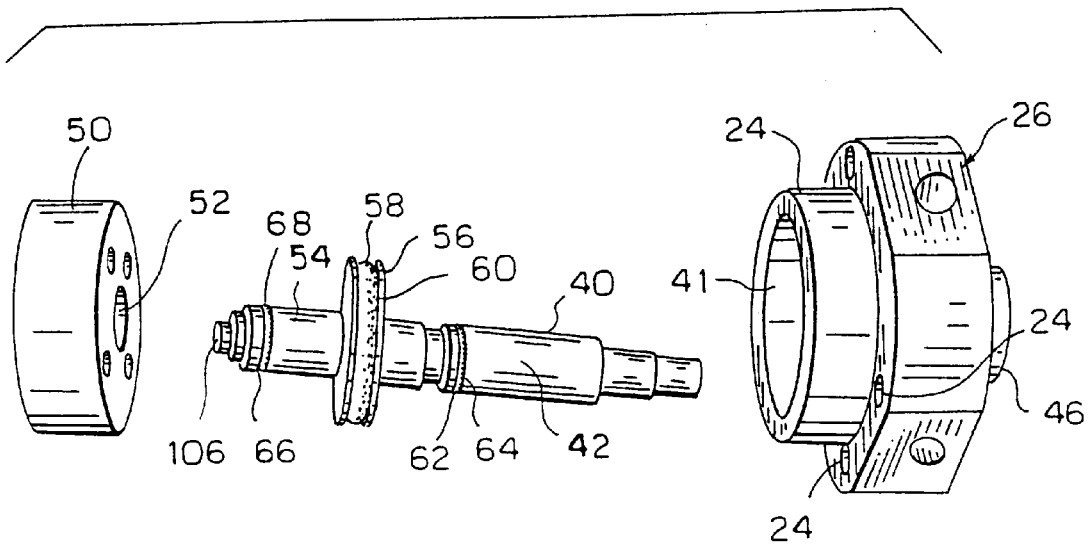
FIG. 5B is an exploded perspective view of the actuator of FIG. 5A shown detached from the balancing machine.
Figure 6:
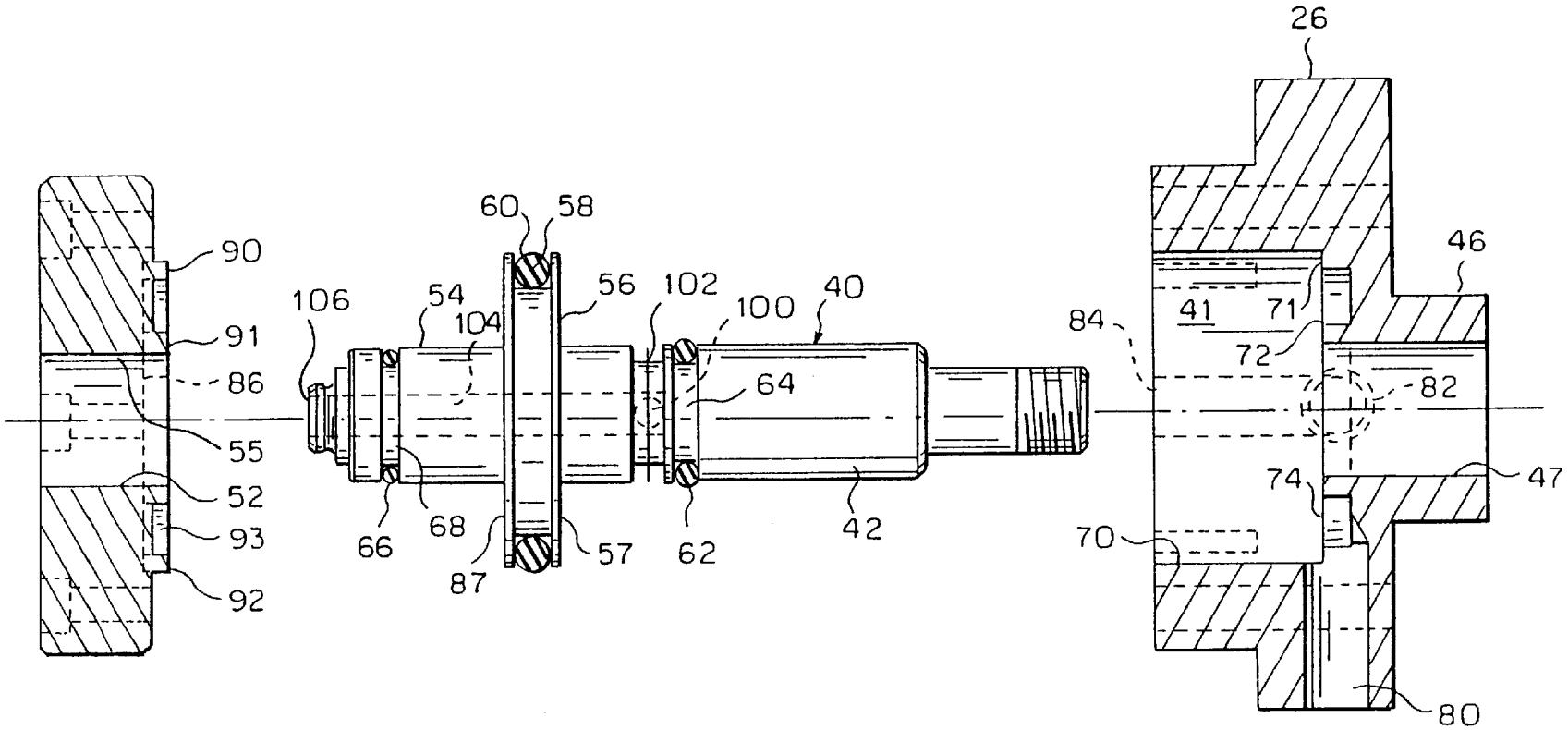
FIG. 6 is a side elevation of the components of the actuator of FIGS. 5A and 5B prior to assembly.

Referring now to FIGS. 5A and 5B, it is seen that the actuator 20 is configured as a unit which is readily attachable to and detachable from the balancing machine 10 by the bolts 22 passing through the holes 24. The operating shaft 40 is positioned within a chamber 41 of the housing 26 by a first portion 42 received through a collar 46 on the housing. The collar 46 has a cylindrical inner wall 47 which stabilizes a first end of the operating shaft 40. Housing 26 is closed by a closure cap 50 which has a central opening 52 therethrough which receives second portion 54 of the operating shaft 40 to enclose a piston 56 within the chamber 41 of the housing 26. Operating shaft 40 has first O-ring 58 disposed in a groove 60 in the piston 56. A second O-ring 62 is positioned in a groove 64 within the first portion 42 of the shaft 40 which seals with the interior wall 47 of the collar 46, and a third O-ring 66 fits in a groove 68 in the second portion 54 of the operating shaft 40 to seal with the central opening 52 through the closure cap 50.

Figure 9:
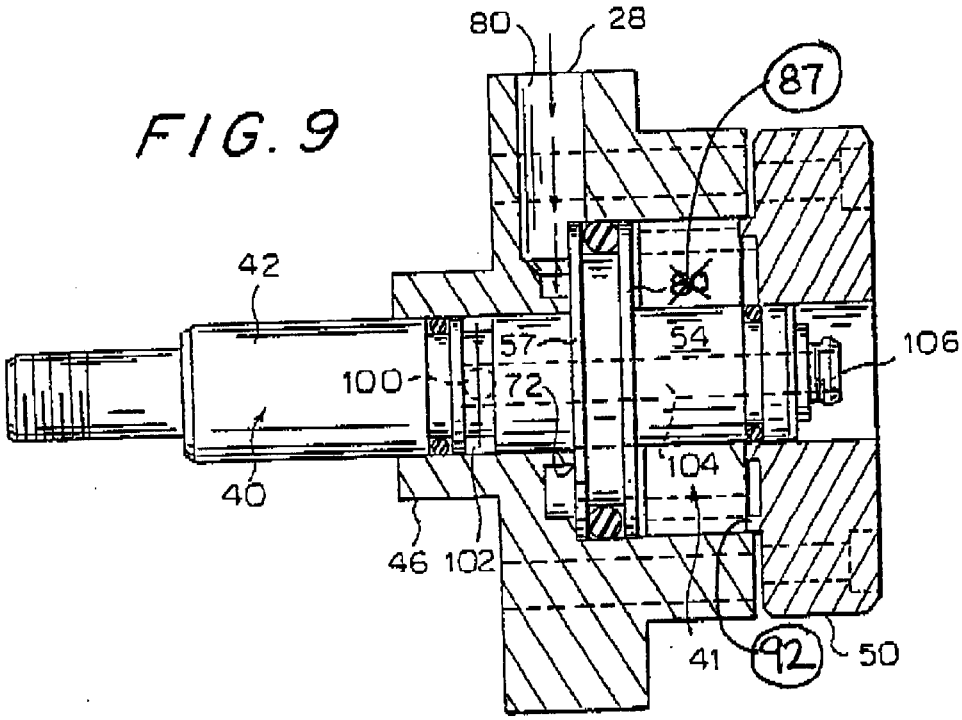
FIG. 9 is a side elevation of the assembled actuator in an uncoupled mode taken along line 9—9 of FIGS. 7 and 8.
Figure 10:
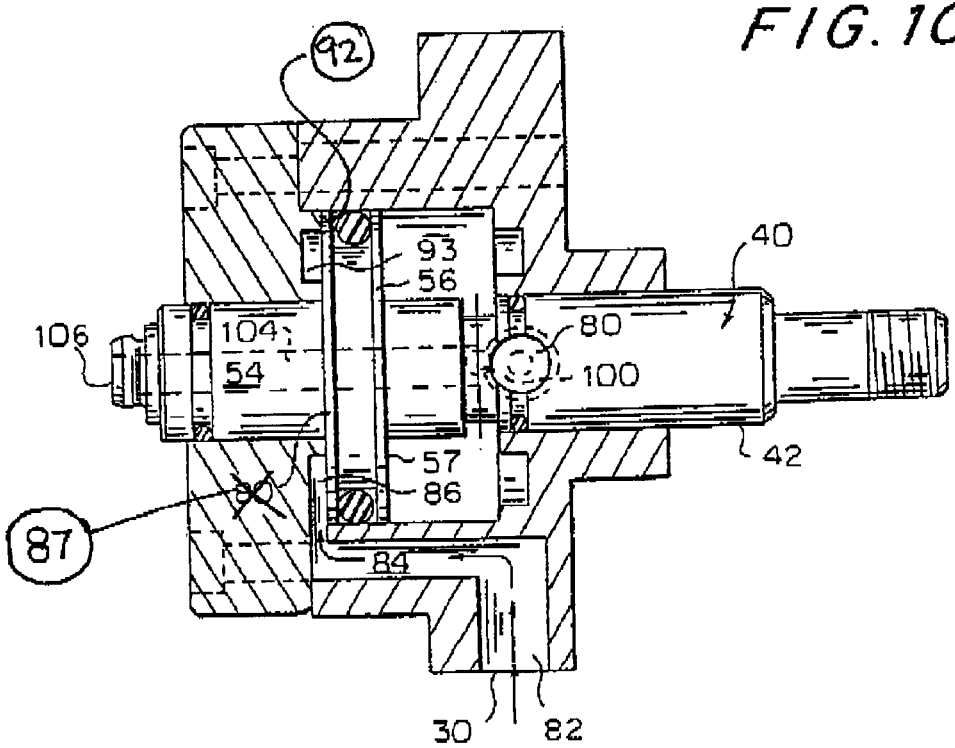
FIG. 10 is a side elevation of the actuator shown in a coupling mode taken along lines 10—10 of FIGS. 7 and 8.

The chamber 41 of housing 26 has internal cylindrical wall 70 which the O-ring 58 seals as the piston 56 moves from a first position (FIG. 9) to a second position (FIG. 10). A first stop surface 71 is provided at the back of the chamber 41 for engaging the piston 56 when the piston 56 is in the first position of FIG. 9. The stop surface 71 has an annular recess 72 therein which has an opening 74 through the stop surface 71 to communicate with the chamber 41. Extending radially through the housing 26 is the first pressure port 28 (FIG. 2) which is connected to the pressure line 32 of FIG. 2 and a second pressure port 30 (FIG. 2) which is connected to the pressure line 34 of FIG. 2. The port 80 is in communication with the annular recess 72 and applies pressure to the back face 57 of the piston 56 which is pushed away from the first stop wall 71 by air pressure in line 32. Air pressure in lines 34 applied through second pressure port 82 flows in an axial bore 84 in housing 26 to a radial channel 86 in closure cap 50 to carry pressurized air to the back face 87 of piston 26.

The closure cap 50 has an annular rim 90 which slides within the cylindrical wall 70 of the chamber 41 and a rim 91 which is congruent with the central opening 52 through the closure cap that surrounds and seals with the second portion 54 of the operating shaft 40. The rims 90 and 91 provide a second stop surface 92 which engages the back face 87 of the piston 56 when the piston 56 is in the actuated position of FIGS. 11 and 12. An annular recess 93 is defined by the annular rims 90 and 91 and is connected to the radial channel 86 which communicates with the axial bore 84 so that pressure applied to radial bore 82 will presurize the back face 87 of the piston 56 so as to return the piston to its first position of FIG. 9.

Figure 7:
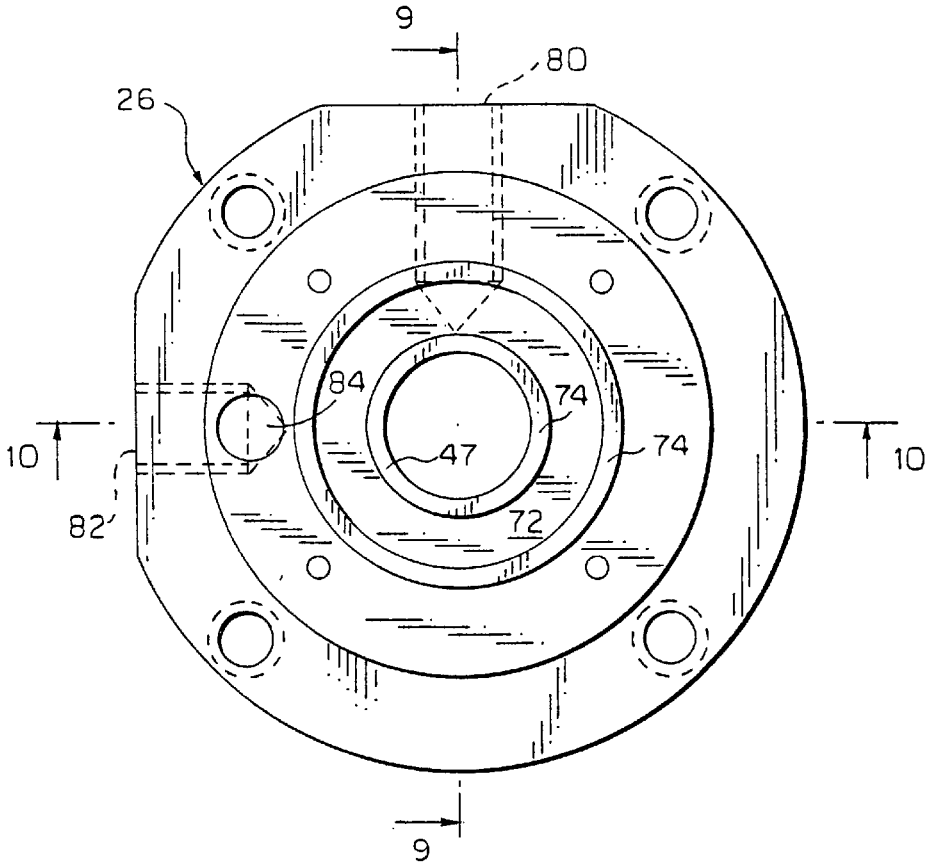
FIG. 7 is an inside planar view of a housing of the actuator shown in FIGS. 5A and 5B.
Figure 8:
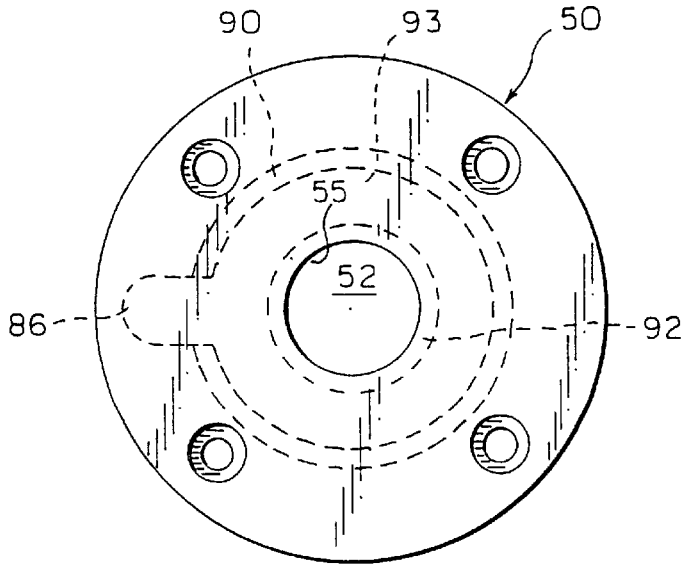
FIG. 8 is an outside end view of a closure cap shown in FIGS. 5A and 5B.

An understanding of the communication between the second raidal bore 82 and longitudinal bore in the housing 56 is best explained with reference to FIGS. 7 and 8 which show end views of the housing 26 and the closure cap 50, respectively. Note in FIG. 7 that the second radial bore 82 intersects the longitudinal bore 84 and that the longitudinal bore 84 extends through the material of the housing. Further, note in FIG. 8 that the radial channel 86 is aligned with the longitudinal bore 84 and in communication with the annular recess 93 which opens into the chamber 41 and faces the back face 87 of the piston 56. When pressurized air is applied through the second radial bore 82, the pressurized air pressurizes the longitudinal bore 84 and thus radial channel 86 and annular recess 93. As will be explained with reference to FIGS. 9 and 10, this pressure moves the piston 56 and the shaft 40 fixed thereon to the decoupled position shown in FIG. 3 and FIG. 10.

Considering now FIGS. 9 and 10, in FIG. 9 the piston is shown with its front face 57 in abutment with the stop surface 74 in the chamber 41 of the housing 26. When air pressure is applied to the first radial bore 80, which communicates with the first annular recess 72, pressure is applied to the front face 57 of the piston 56. The piston 56 then moves toward the second stop surface 92 on the closure cap 50 so that the operating shaft 40 enters the air chuck 11 as show in FIG. 4.

The operating shaft 40 has a lateral bore 100 which while in the uncoupled mode of FIG. 9 remains within the collar 46 and covered by the wall 47 of collar 46 so that pressurized air does not initially flow into the lateral bore. The lateral bore 100 within the operating shaft 40 opens into a circumferential groove 102 in the operating shaft and communicates with a longitudinal bore 104 extending through the second portion 54 of the operating shaft 40. The longitudinal bore 104 opens through a coupling end 106 of the operating shaft 40 which penetrates the air chuck 11 of FIGS. 3 and 4 to supply pressurized air thereto in order to couple the air chuck to an element such as the drive shaft 12 to the rotated by the balance machine 10 (see FIG. 1).

Pressurized air does not begin to flow through the longitudinal bore 104 until the circumferential groove 102 on operating shaft aligns with the annular recess 72 in the chamber 41 of housing 26 as the rear face 87 of the piston 56 moves into direct abutment with the second stop face 92. Pressurized air then rushes thorugh lateral bore 100 and pressurizes longitduinal bore 104 as well as the air chuck 11 just after the coupling end 106 seats within the chuck as shown in FIG. 4.

The drive shaft 12, or other element, is rotated by the balancing machine 10 at relatively high speed to test for balance. At the conclusion of the test rotation of the chuck 11 and drive shaft 12 ceases and the operating shaft 40 is returned to the first position of FIG. 9 by applying pressure to radial bore 82, through longitudinal bore 84 and to the second annular recess 93, via radial channel 86 in the closure cap 50. Air pressure on back face 87 of piston 56 then forces operating shaft 40 to disengage coupling end 106 from the air chuck 11. Any residual air pressure in the operating shaft exhausts to the atmosphere as the operating shaft is returned to the uncoupled mode of FIG. 9 and air in the chamber 41 is pushed out of the now unpressurized first radial bore 80.

Figure 11:
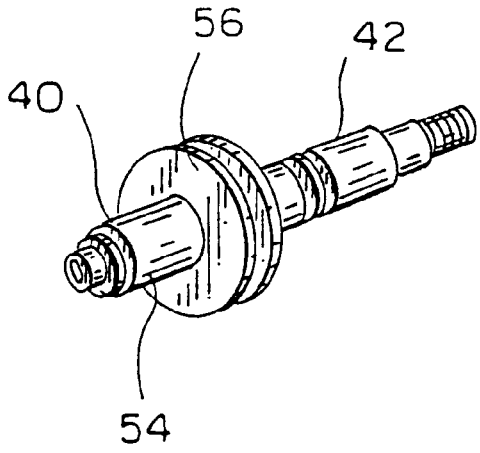
FIG. 11 is a perspective side view of a first embodiment of an operating shaft configured in accordance with the principles of the present invention.
Figure 12:
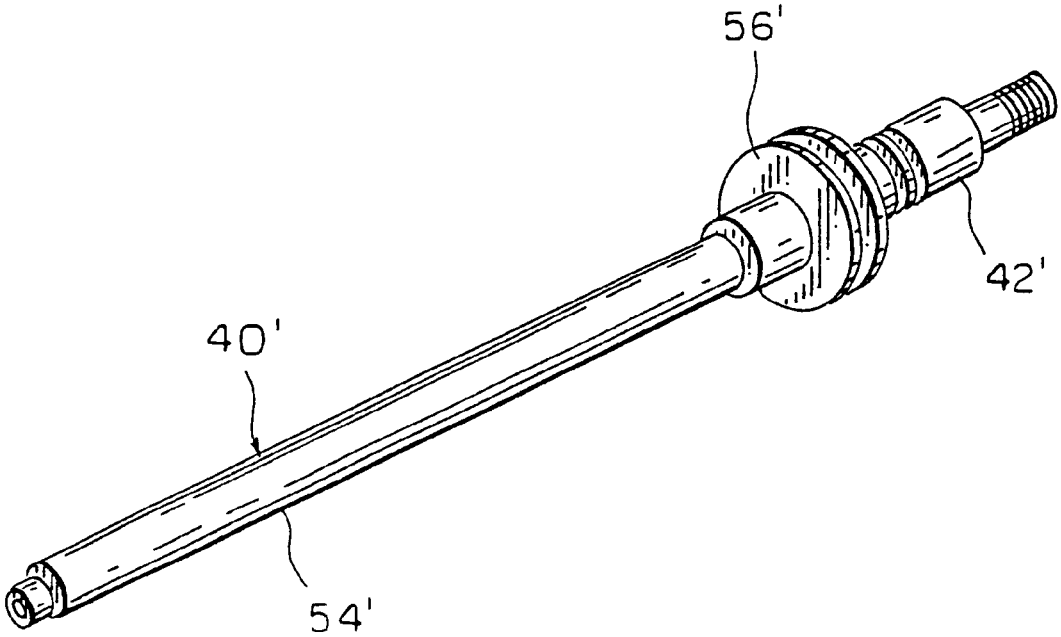
FIG. 12 is a perspective side view of a second embodiment of an operating shaft configured in accordance with the principles of the present invention.

FIG. 11 shows a first embodiment of the operating shaft 40, which has a relatively short second portion 54, while FIG. 12 shows a second embodiment of the operating shaft 40', which has a relatively long second portion 54' that cooperates with a different balancing machine arrangement.

From the foregoing description, one skilled in the art can easily ascertain the essential characteristics of this invention, and without departing from the spirit and scope thereof, can make various changes and modifications of the invention to adapt it to various usages and conditions.

We claim:

1. An actuator for actuating and providing air to an air chuck for coupling an object for rotation, comprising:

a housing defining cylindrical chamber having a first surface stop and having a first pressure line connected to a first side of the chamber, and a second pressure line connected to a second side of the chamber for applying pressure to the second side of the chamber; and an operating shaft positioned within the chamber of movement between a first position and a second position, the shaft having a longitudinal bore for delivering air to the air chuck, which longitudinal bore is in communication with a radially extending bore;

a piston disposed around the operating shaft and being reciprocally mounted in the chamber; wherein when the pressurized air is applied to the first side of the chamber the piston is shifted against a second stop surface at the second side of the chamber, allowing pressurized air to flow through the bores in the operating shaft to the air chuck, and wherein when pressurized air is applied to the second side of the chamber, the piston moves away from the stop wall to move the piston to the first position from the second position while air within the operating shaft is depressurized allowing the air chuck to decouple the operating shaft and chuck from the object being rotated.

2. The air coupling of claim 1, wherein the operating shaft is not spring biased.

3. The air coupling of claim 2 wherein the radially extending bore in the operating shaft is closed when the operating shaft is in the first position and open when the operating shaft is in the second position.

4. The actuator of claim 3 wherein there is an axial distance between the radial bore in the shaft and the back face of the piston which is no greater than an axial distance between the second top surface and the first recess, wherein when the chamber is pressurized air does not flow through the radial bore in the operating shaft until the piston is at the second stop surface.

5. The actuator of claim 4 wherein the connection to the second side of the chamber comprises a recess in the second side of the chamber which communicates directly with the chamber and is connected by a radial channel in an end cap closing the housing to a longitudinal bore in the housing which extends to a location in the housing adjacent to the first side of the chamber where the lateral bore is connected to the second pressure line.

6. The actuator of claim 1 wherein the connection to the second side of the chamber comprises a recess in the second side of the chamber which communicates directly with the chamber and is connected by a radial channel in an end cap closing the housing to a longitudinal bore in the housing which extends to a location in the housing adjacent to the first side of the chamber where the lateral bore is connected to the second pressure line.

* * * * *